US010527279B2

(12) United States Patent
Ojiro

(10) Patent No.: US 10,527,279 B2
(45) Date of Patent: Jan. 7, 2020

(54) COMBUSTION APPARATUS

(71) Applicant: RINNAI CORPORATION, Aichi (JP)

(72) Inventor: Takashi Ojiro, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 50 days.

(21) Appl. No.: 15/765,531

(22) PCT Filed: Oct. 3, 2016

(86) PCT No.: PCT/JP2016/004445

§ 371 (c)(1),
(2) Date: Apr. 3, 2018

(87) PCT Pub. No.: WO2017/068755

PCT Pub. Date: Apr. 27, 2017

(65) Prior Publication Data

US 2019/0078776 A1 Mar. 14, 2019

(30) Foreign Application Priority Data

Oct. 20, 2015 (JP) ..... 2015-206591

(51) Int. Cl.
*F23D 14/14* (2006.01)
*F23M 5/08* (2006.01)
(Continued)

(52) U.S. Cl.
CPC ..... *F23D 14/14* (2013.01); *F23D 14/02* (2013.01); *F23D 14/78* (2013.01); *F23M 5/08* (2013.01);
(Continued)

(58) Field of Classification Search
CPC ..... F23D 14/14
See application file for complete search history.

(56) References Cited

U.S. PATENT DOCUMENTS 2,767,905 A * 10/1956 Creed ..... F04D 27/009 415/52.1
3,401,000 A * 9/1968 Spaonara ..... F23C 99/00 431/329

(Continued)

FOREIGN PATENT DOCUMENTS

| | | | |
|---|---|---|---|
| EP | 2811141 | A1 | 12/2014 |
| JP | 9-280549 | A | 10/1997 |
| JP | 2007-078281 | A | 3/2007 |
| JP | 2009-030908 | A | 2/2009 |
| JP | 2013-133955 | A | 7/2013 |

OTHER PUBLICATIONS

International Search Report and Written Opinion for PCT Patent App. No. PCT/JP2016/004445 (dated Dec. 27, 2016) with English translation of the ISR.

*Primary Examiner* — Nathaniel Herzfeld
(74) *Attorney, Agent, or Firm* — Cermak Nakajima & McGowan LLP; Tomoko Nakajima

(57) ABSTRACT

A combustion apparatus includes a burner having a sheet-metal combustion plate which covers an open surface of a burner body; and a combustion box having a connection flange part to be coupled to a body flange part enclosing the open surface of the burner body, and is equipped with a cooling means for cooling the combustion box, an arrangement is made that overheating of the burner body due to heat transmission from the combustion plate can be prevented, even without enhancing thermal insulation performance of a packing to be interposed between a combustion plate flange part and the body flange part. The connection flange part is kept in direct contact with the combustion plate flange part and, coupled to the body flange part. The packing is provided with: a combustion plate seal part to be pressed under pressure against the combustion plate flange part; and a combustion box seal.

7 Claims, 6 Drawing Sheets

(51) Int. Cl.

| | |
|---|---|
| ***F23D 14/78*** | (2006.01) |
| ***F24H 1/12*** | (2006.01) |
| ***F23D 14/02*** | (2006.01) |
| ***F24H 9/00*** | (2006.01) |
| ***F24H 9/18*** | (2006.01) |
| *F24H 9/20* | (2006.01) |

(52) U.S. Cl.
CPC ..... *F24H 1/124* (2013.01); *F24H 9/0015* (2013.01); *F24H 9/0026* (2013.01); *F24H 9/1818* (2013.01); *F24H 9/1836* (2013.01); *F24H 9/1845* (2013.01); *F23B 2700/003* (2013.01); *F24H 9/2035* (2013.01); *F24H 2230/00* (2013.01); *F24H 2250/02* (2013.01)

(56) References Cited

U.S. PATENT DOCUMENTS

| | | | | |
|---|---|---|---|---|
| 4,737,102 | A * | 4/1988 | Jinno | F23C 5/02 122/18.4 |
| 7,523,721 | B2 * | 4/2009 | Hamada | F24H 1/43 122/31.1 |
| 2010/0116226 | A1 * | 5/2010 | Lovascio | F23D 14/78 122/367.1 |
| 2012/0301836 | A1 * | 11/2012 | Akagi | F23D 14/02 431/328 |
| 2014/0000534 | A1 * | 1/2014 | Naitoh | F24H 9/2035 122/14.21 |
| 2016/0116228 | A1 * | 4/2016 | Huang | F28D 21/0007 122/18.2 |

* cited by examiner

COMBUSTION APPARATUS

This application is a national phase entry under 35 U.S.C. § 371 of PCT Patent Application No. PCT/JP2016/004445, filed on Oct. 3, 2016, which claims priority under 35 U.S.C. § 119 to Japanese Patent Application No. 2015-206591, filed Oct. 20, 2015, both of which are incorporated by reference.

TECHNICAL FIELD

The present invention relates to a combustion apparatus provided with: a burner made up of a burner body which is supplied therein with air-fuel mixture, and a sheet-metal combustion plate which covers an open surface of the burner body and has an ejection part for the air-fuel mixture; and a combustion box which has, at one end, a connection flange part to be coupled, by a fastening operation, to a body flange part enclosing the open surface of the burner body, and which contains therein a heat exchanger.

BACKGROUND ART

As this kind of combustion apparatus, there is known an apparatus from patent document 1 in which, in order to improve the heat resistivity of the combustion box, a water tube on an upstream side of a heat exchanger is disposed in a portion of the combustion box between the burner and the heat exchanger, as a cooling means for cooling the combustion box. Further, in this arrangement: a first packing is interposed between a combustion plate flange part on a circumference of the combustion plate which protrudes outward beyond an inner circumference of the body flange part and the body flange part; and a second packing is interposed between the combustion plate flange part and the connection flange part. In this arrangement, by the fastening operation the connection flange part to the body flange part, a combustion plate seal part disposed in the first packing will be compressed between the combustion plate flange part and the body flange part and, consequently, the sealing performance between the combustion plate flange part and the body flange part are secured. At the same time, a combustion box seal part disposed in the second packing will be compressed between the connection flange part and the combustion plate flange part and, consequently, the sealing performance between the connection flange part and the combustion plate flange part is secured.

By the way, the sheet-metal combustion plate will rise to a considerably high temperature at the time of combustion. Then, at the time of weak combustion at which the amount of air-fuel mixture in the burner body is small, the cooling function by the air-fuel mixture will be reduced and the heat is likely to be accumulated in the burner body. As a result, when the heat in the combustion plate is transmitted to the burner body, the burner body will rise to a considerably high temperature. As a consequence, an auxiliary part of the burner body, such as a check valve to be disposed in an inlet port to the burner body, will be subjected to a bad effect due to heat. In this case, it is conceivable to constitute the first packing in ceramic packing that is superior in thermal insulation performance so that the heat from the combustion plate becomes less likely to be transmitted to the burner body. This solution, however, becomes higher in cost.

PRIOR ART DOCUMENT

Patent Documents

Patent Document 1: Specification of EP-A-2811141

SUMMARY OF THE INVENTION

Problems that the Invention is to Solve

This invention has a problem of providing a combustion apparatus which is arranged to prevent the burner body from being overheated due to heat transmission from the combustion plate, even if the thermal insulation performance of the packing to be interposed between the combustion plate flange part and the body flange part is not increased.

Means for Solving the Problems

In order to solve the above problem, this invention has a feature in that a combustion apparatus comprises: a burner made up of a burner body which is supplied therein with air-fuel mixture, and a sheet-metal combustion plate which covers an open surface of the burner body and has an ejection part for the air-fuel mixture; a combustion box which has, at one end, a connection flange part adapted to be coupled to a body flange part enclosing the open surface of the burner body, the combustion box containing therein a heat exchanger; and cooling means which is disposed in that portion of the combustion box which lies between the burner and the heat exchanger, thereby cooling the combustion box. A packing is interposed between the body flange part and a combustion plate flange part on a circumference of the combustion plate which protrudes outward beyond an inner circumference of the body flange part. The connection flange part is coupled to the body flange part by a fastening operation in a state in which the connection flange part is in direct contact with the combustion plate flange part, and the packing has a combustion plate seal part which is compressed, as a result of the fastening operation, between the combustion plate flange part and the body flange part.

According to this invention, since the connection flange part is in direct contact with the combustion plate flange part, the heat from the combustion plate can be dissipated to the connection flange part to which is transmitted the cold by the cooling means. Therefore, without increasing the thermal insulating performance of the packing to be interposed between the combustion plate flange part and the body flange part, overheating of the burner body due to heat transmission from the combustion plate can be prevented. As a result, there is no need of using, as a packing, a ceramic packing and, as compared with an example in which a ceramic packing is used, the cost reduction can be attained.

Further, in this invention, preferably the body flange part has a projection which is formed so as to contact the combustion plate flange part through a hole formed in the packing. According to this arrangement, the combustion plate flange part will, as a result of a push by the projection, surely come into contact with the connection flange part, whereby the reliability of heat transfer from the combustion plate flange part to the connection flange part will be improved. Further, the clearance between the combustion plate flange part and the body flange part will not be made smaller than the height of the projection. Therefore, the compression allowance in the combustion plate seal part can be adequately controlled.

By the way, by securing the sealing performance, by the combustion plate seal part, between the combustion plate flange part and the body flange part, leaks of the air-fuel mixture from the clearance between both the flange parts can be prevented. However, in a state in which the connection flange part remains to be in direct contact with the combustion plate flange part, combustion exhaust gas will be leaked from the clearance between the connection plate flange part and the combustion plate flange part.

For that reason, in this invention, preferably, an outer circumference of the combustion plate flange part is positioned on an inner side of an outer circumference of the body flange part. The connection flange part and the packing respectively have protruded parts which protrude outward beyond the outer circumference of the combustion plate flange part, and a combustion box seal part is disposed at the protruded part of the packing so as to be compressed, as a result of the fastening operation, between the protruded part of the connection flange part and the body flange part. According to this arrangement, the single packing can secure not only the sealing performance between the combustion plate flange part and the body flange part but also the sealing performance between the connection flange part and the body flange part. The combustion exhaust gas can be prevented from leaking outside, to the advantage from the cost-wise point of view Further, in this invention, preferably, the outer circumference of the body flange part has a bent edge part which is bent so as to come into contact with an outer circumference portion of that surface of the protruded part of the connection flange part which faces the body flange part. According to this arrangement, the heat can be dissipated from the body flange part through the bent edge part toward the connection flange part so that overheating of the burner body can more effectively be prevented. Further, the clearance between the protruded part of the connection flange part and the body flange part will never be made narrower than the height of the bent edge part. The compression allowance of the combustion box seal part can adequately be controlled.

By the way, in order to prevent, from leaking, the combustion exhaust gas from the coupling position of the connection flange part to the body flange part, the coupling position of the connection flange part to the body flange part must be positioned outside the outer circumference of the combustion plate flange part, and also outside the combustion box seal part so that combustion exhaust gas entering the contact part between the combustion plate flange part and the connection flange part can be prevented from reaching the coupling position. In this case, a notched part may be formed in the outer circumference of the combustion plate flange part so as to be positioned at the circumference coinciding with the coupling position, and a circumference coinciding with the coupling position of the combustion box seal part is bent inward so as to be contained into the notched part. In this manner, the coupling position can be deviated inside. As a result, the outer circumference of the connection flange part and the body flange part need not be swelled outward at the circumference coinciding with the coupling position, whereby an attempt can be made to downsize the combustion apparatus.

EMBODIMENTS FOR CARRYING OUT THE INVENTION

Figure 1:
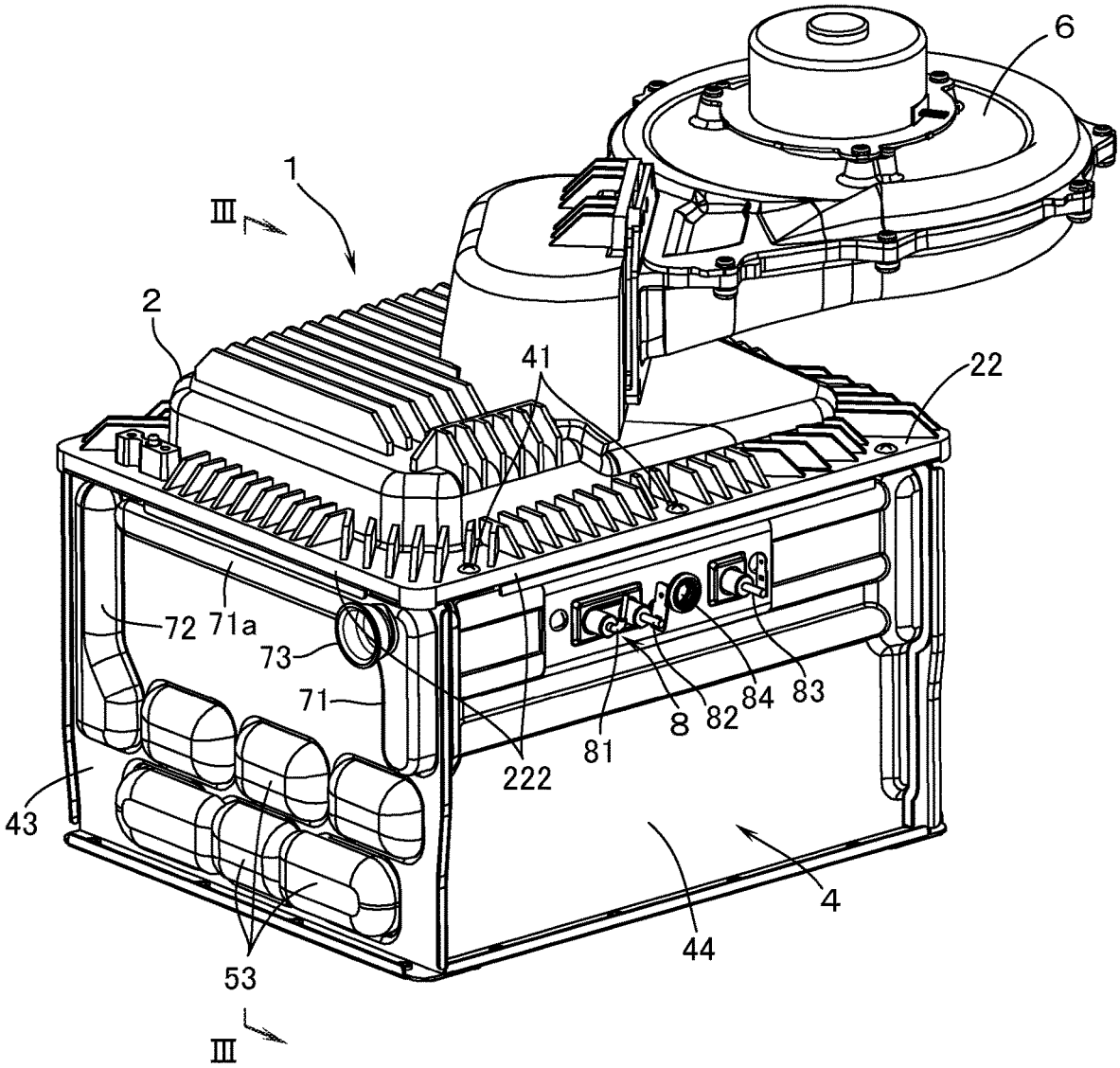
FIG. 1 is a perspective view of a combustion apparatus of an embodiment of this invention.

With reference to FIGS. 1 through 4, a combustion apparatus according to an embodiment of this invention is provided with: a burner 1 made up of a burner body 2 which is supplied inside thereof with air-fuel mixture (mixture gas of fuel gas and primary air), and a combustion plate 3, made by a sheet metal, which covers a downward open surface 21 of the burner body 2; and a combustion box 4 which has, at an upper end, a connection flange part 42 to be coupled, with machine screws 41, to a body flange part 22 which encloses the open surface 21 of the burner body 2. The combustion box 4 contains, inside thereof, a heat exchanger 5 for supplying hot water.

The burner body 2 has opened therein an inlet port 23 to which is connected a fan 6 for supplying air-fuel mixture. The inlet port 23 has mounted therein a check valve 24 which prevents, at the time of fan stopping, the air-fuel mixture staying inside the burner body 2 from flowing back toward the fan 6. The check valve 24 is constituted by: a resin valve box 241 and fitted into the inlet port 23; and a resin valve plate 242 which is mounted in an opening portion of the valve box 241 which looks inside the burner body 2, in a manner to be swingable about an axis between opened or closed posture. The combustion plate 3 has a large opening portion in the center thereof. This opening portion has mounted therein a canvass 31*a* made of heat-resistant fiber and mounted thereon, in an overlapped manner, a distribution plate 31*b* which has formed therein a multiplicity of distribution holes. An ejection part 31 for the air-fuel mixture is thus constituted by the canvass 31*a* and the distribution plate 31*b*. The air-fuel mixture supplied by the fan 6 into the burner body 2 is ejected out of the ejection part 31 for totally primary air combustion. By the way, it is also possible to form a multiplicity of burner ports in the combustion plate having no large opening so that these burner ports constitute the ejection part for the air-fuel mixture.

The heat exchanger 5 is constituted by a fin-tube type of heat exchanger having; a multiplicity of fins 51; and a plurality of heat-absorbing tubes 52 which penetrate through these fins 51. On outside surfaces of side plates 43 on laterally both sides of the combustion box 4, there are mounted a plurality of connection covers 53 which define, together with each of the side plates 43, connection passages for the adjoining two heat-absorbing pipes 52, 52. All of the heat-absorbing tubes 52 are thus connected in series with each other. In addition, the connection cover 53 which defines, together with the side plate 43, a connection passage for the heat absorbing pipe 52 on the downstream end, is provided with a hot water outlet 54.

Figure 2:
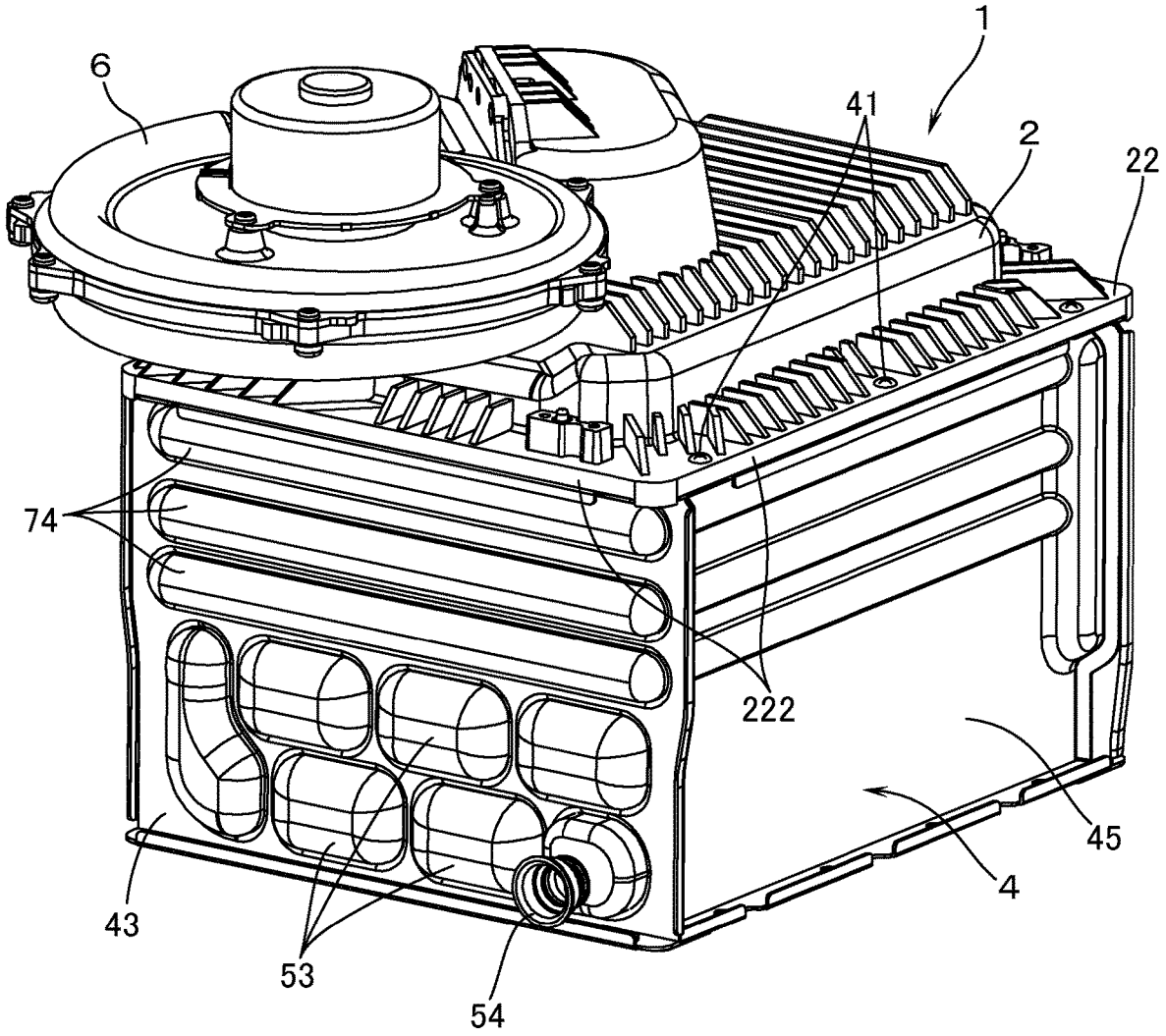
FIG. 2 is a perspective view of the combustion apparatus of the embodiment as viewed from a side opposite to that in FIG. 1.
Figure 3:
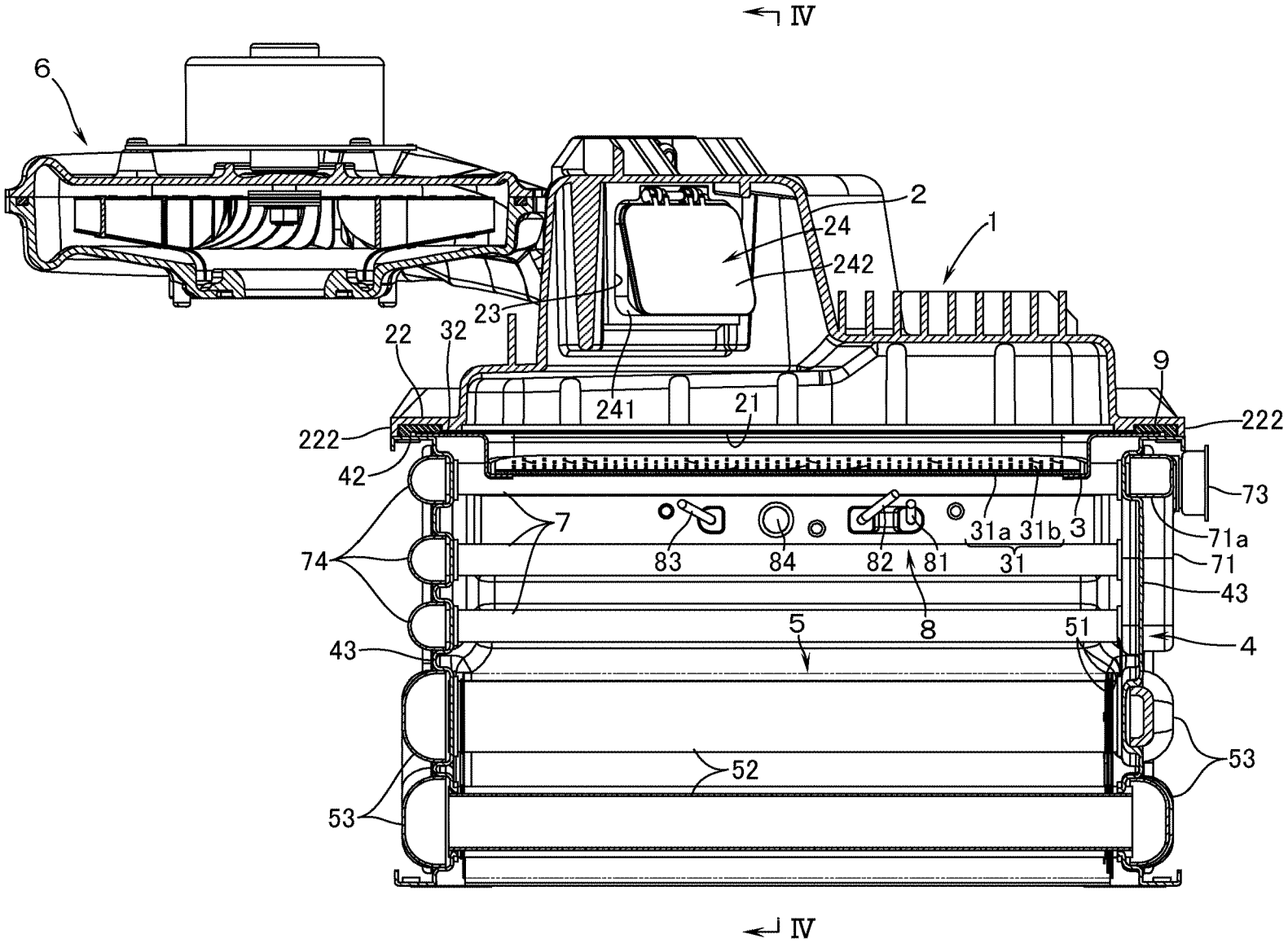
FIG. 3 is a sectional view cut away along the line III-III in FIG. 1.
Figure 4:
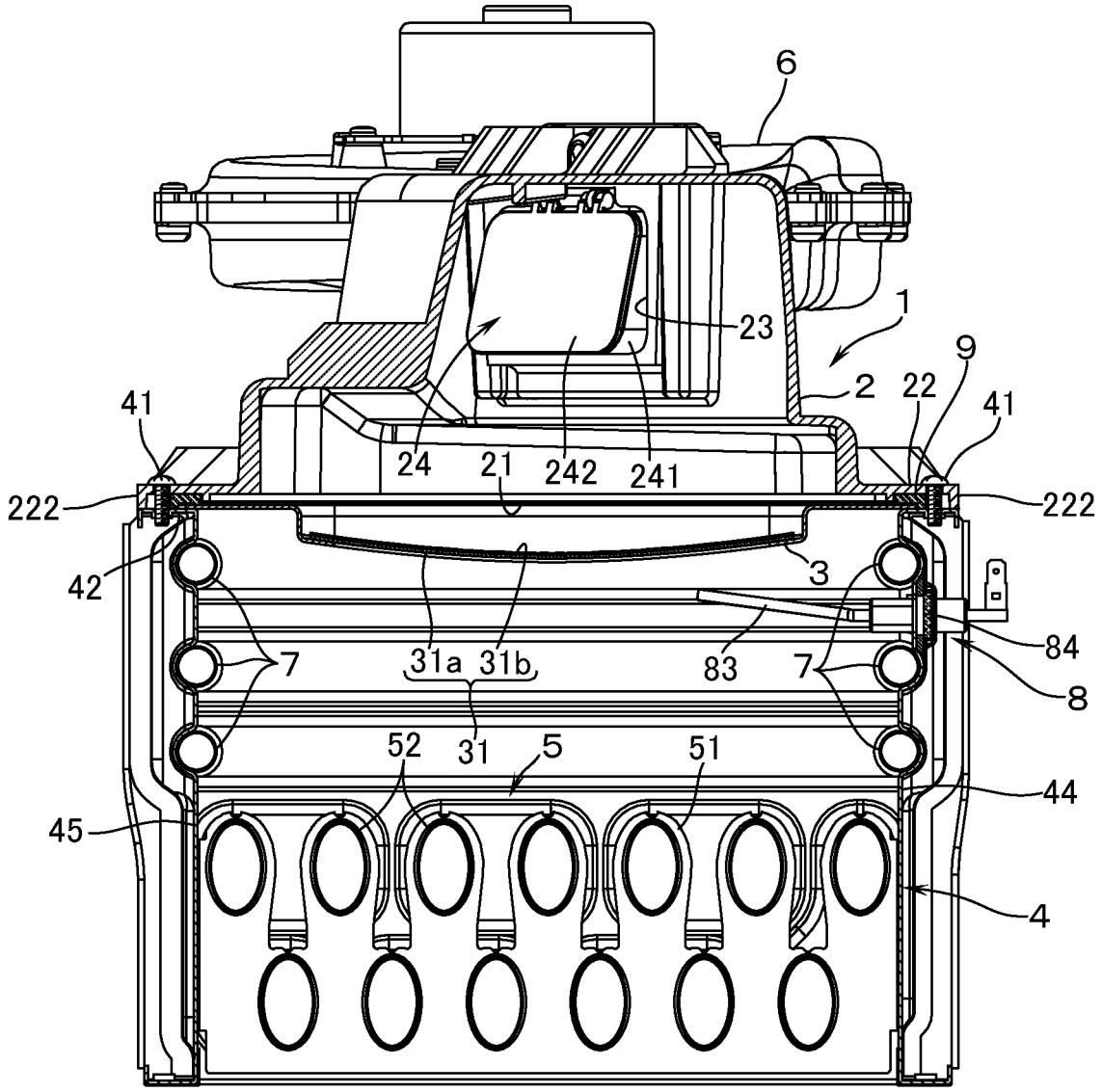
FIG. 4 is a sectional view cut away along the line IV-IV in FIG. 3.

Further, on an inside of those portions of a front-side side plate 44 and a rear-side side plate 45 which lie above the heat exchanger 5, there are respectively vertically arranged three water tubes 7 in a manner to be in contact with each of the side plates 44, 45 so as to cool the combustion box 4. Further, on an outside surface on laterally one-side side plate 43 of the combustion box 4, there are disposed inlet-side header cover 71 which defines, together with the side plate 43, a connection passage for the three water tubes 7 vertically arranged on the front side; and outlet-side header cover 71 which defines, together with the side plate 43, a connection passage for the three water tubes 7 vertically arranged on the rear side. On the inlet-side header cover 71 there is provided a water inlet port 73. Further, on an outside surface of the side plate 43 on the laterally opposite side of the combustion box 4, there are mounted connection covers 74 which define, as shown in FIG. 2 and FIG. 3, a connection passage between the front-side water tube 7 and the rear-side water tube 7. Then, water is supplied from the water inlet port 73 to the heat exchanger 5 through the connection passage inside the inlet-side header cover 71, the front-side water tube 7, the connection passage inside the connection cover 74, the rear-side water tube 7, and the connection passage inside the outlet-side header cover 72. It is thus so arranged that hot water heated in the heat exchanger 5 is supplied out of the hot water outlet port 54. Accordingly, the front-side and rear-side water tubes 7, the connection passages inside the header covers 71,72 on the inlet and the outlet sides, and the connection passages inside the connection passage 74 constitute the cooling means to be disposed in that portion of the combustion box 4 which lies between the burner 1 and the heat exchanger 5. By the way, the inlet-side header cover 71 has a portion 71*a* which is elongated from the front side to the rear side in order to cool the side plate 43 on laterally one side of the combustion box 4.

In addition, the front-side side plate 44 of the combustion box 4 has mounted thereon an electrode component 8 having an ignition electrode 81, a ground electrode 82, and a flame rod 83 which penetrate the side plate portion between the first and the second, i.e., totally two, water tubes from the top to thereby protrude into the combustion box 4. By the way, the electrode component 8 is additionally provided with an inspection window 84 which enables visual confirmation inside the combustion box 4.

Figure 5:
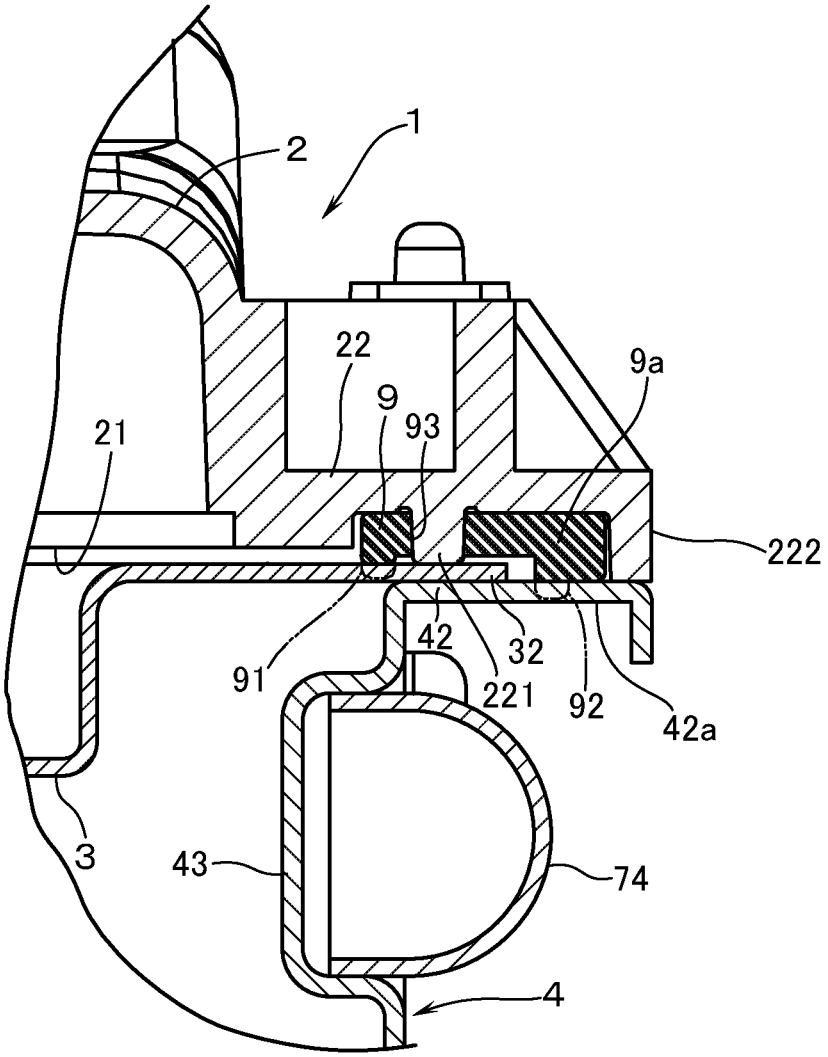
FIG. 5 is an enlarged sectional view of an essential portion of the combustion apparatus of the embodiment.

As clearly shown in FIG. 5, in the circumference of the combustion plate 3, there is disposed a combustion plate flange part 32 which protrudes outward beyond an inner circumference of the body flange part 22. Between this combustion plate flange part 32 and the body flange part 22, there is interposed a packing 9. The outer circumference of the combustion plate flange part 32 is positioned on the inner side of the outer circumference of the body flange part 22. Further, the connection flange part 42 has a protruded part 42*a* which protrudes outward beyond the outer circumference of the combustion plate flange part 32. The packing 9 also has a protruded part 9*a* which protrudes outward beyond the outer circumference of the combustion plate flange part 32. Then, a combustion plate seal part 91, which protrudes downward in a free state as shown in imaginary lines in FIG. 5, is formed over the entire circumference and, in that portion of the protruded part 9*a* of the packing 9 which corresponds to the protruded part 42*a* of the connection flange part 42, there is formed a combustion box seal part 92 which protrudes downward in a free state.

By the way, at the time of weak combustion at which the amount of air-fuel mixture inside the burner body 2 is small, the cooling function by the air-fuel mixture is reduced and the heat is likely to be accumulated in the burner body 2. Further, the sheet-metal combustion plate 3 will rise to a considerably high temperature. As a result, when the heat of the combustion plate 3 is transmitted to the burner body 2, the burner body 2 will rise to a considerably high temperature. As a consequence, the check valve 24, which is an auxiliary part of the burner body 2, will be subjected to a bad effect due to heat. In this case, it is conceivable to constitute the packing 9 in ceramic packing that is superior in thermal insulation performance so that the heat is hardly transmitted from the combustion plate 3 to the burner body 2. This solution, however, becomes higher in cost.

As a solution, in this embodiment, the connection flange part 42 is coupled to the body flange part 22 in a state in which the connection flange part 42 is in direct contact with the combustion plate flange part 32. According to this arrangement, the heat from the combustion plate 3 can be released to the connection flange part 42 to which the cold by the cooling means is transmitted. Therefore, even if the packing 9 to be interposed between the combustion plate flange part 32 and the body flange part 22 is of an ordinary rubber make, the burner body 2 can be prevented from being overheated due to the heat transmission from the combustion plate 3. Consequently, as compared with a case in which a ceramic packing is used as the packing 9, the cost reduction can be attained.

Furthermore, when the connection flange part 42 is coupled to the body flange part 22, the combustion plate seal part 91 is compressed between the combustion plate flange part 32 and the body flange part 22. According to the arrangement, by securing the sealing performance between the combustion plate flange part 32 and the body flange part 22, leaks of the air-fuel mixture from the clearance between both the flanges 32, 22 can be prevented. However, by simply leaving the connection flange part 42 in a state of being in direct contact with the combustion plate flange part 32, the combustion exhaust gas may give rise to leaks through the clearance between the connection flange part 42 and the combustion plate flange part 32.

As a solution, according to this embodiment, as a result of coupling of the connection flange part 42 to the body flange part 22, an arrangement is made that the combustion box seal part 92 is compressed between the protruded part 42*a* of the connection flange part 42 and the body flange part 22, the combustion box seal part 92 is compressed. According to this arrangement, by means of the single packing 9, not only can the sealing performance be secured between the combustion plate flange part 32 and the body flange part 22, but also can the sealing performance be secured between the connection flange part 42 and the body flange part 22. Leaks of the combustion exhaust gas to the outside can be prevented to the advantage from the cost viewpoint.

Further, according to this embodiment, in a plurality of circumferential positions of the body flange part 22, as shown in FIG. 5, projections 221 are formed in a manner to come into contact with the combustion plate flange part 32 through holes 93 formed in the packing 9. According to this arrangement, as a result of being pushed by the projections 221, the combustion plate flange part 32 will surely come into contact with the connection flange part 42. The reliability of heat transmission from the combustion plate flange part 32 to the connection flange part 42 can be improved. Still furthermore, even if the machine screws 41 for coupling the connection flange part 42 are overtightened, the clearance between the combustion plate flange part 32 and the body flange part 22, will never be made narrower than the height of the projections 221. The compression allowance of the combustion plate seal part 91 can be adequately controlled. Further, by slightly fitting under pressure the projections 221 into the respective holes 93, the packing 9 can be temporarily fitted relative to the body flange part 22. Therefore, even if the body flange part 22 is made to look downward, the packing 9 will not be dropped out of position, thereby improving the ease of assembling.

With reference to FIG. 5, according to this embodiment, an outer circumference of the body flange part 22 has formed therein a bent edge part 222 which is bent downward so as to come into contact with an outer circumference portion of that surface of the protruded part 42*a* of the connection flange part 42 which faces the body flange part 22. According to this arrangement, the heat is dissipated from the body flange part 22 through the bent edge part 222 toward the connection flange part 42. Overheating of the burner body 2 can thus be more effectively prevented. In addition, since the clearance between the protruded part 42*a* of the connection flange part 42 and the body flange part 22 can never be made narrower than the bent height of the bent edge part 222, the compression allowance of the combustion box seal part 92 can be adequately controlled.

By the way, in order to prevent the leakage of the combustion gas from the coupling portion, i.e., from the portion fixed by the machine screws 41, of the connection flange part 42 relative to the body flange part 22, it is necessary to arrange that the coupling portion with machine screws 41 must be positioned outside the outer circumference of the combustion plate flange part 32, and also outside the combustion box seal part 92 so that combustion exhaust gas entering the contact part between the combustion plate flange part 32 and the connection flange part 42 can be prevented from reaching the portion fixed by the machine screws 41.

Figure 6:
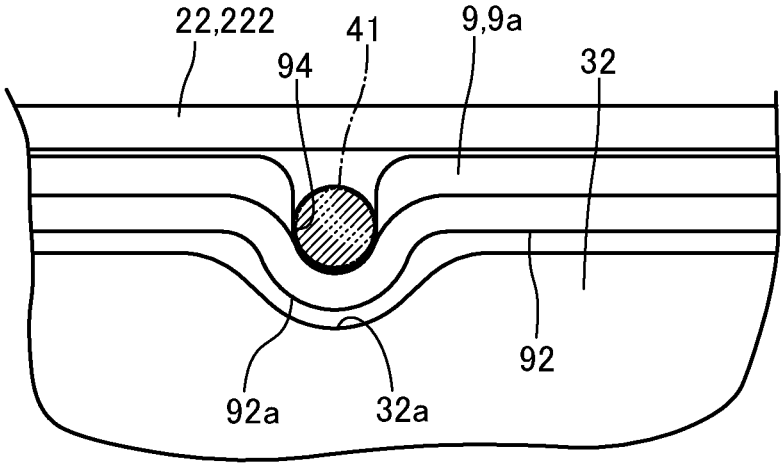
FIG. 6 is an enlarged sectional bottom view of an essential portion before assembling of the combustion box of the combustion apparatus of the embodiment.

Then, in this embodiment, as shown in FIG. 6, notched parts 32*a* are formed in the outer circumference of the combustion plate flange part 32 in a position along circumferences coinciding with the positions of fixing with machine screws 41. In addition, those circumferences 92*a* of the combustion box seal part 92 which coincide with the positions of fixing with the machine screws 41 are bent inward so as to be contained into the notched parts 32*a*. According to this arrangement, the positions of fixing with machine screws 41 can be displaced inward. As a result, the outer circumferences of the connection flange part 42 and the body flange part 22 need not be swelled outward at the circumferences coinciding with the positions of fixing with the machine screws 41, whereby an attempt can be made to downsize the combustion apparatus. By the way, in the example shown in FIG. 6, notched parts 94 are formed in portions where the machine screws 41 of the packing 9 penetrate, but the portions where the machine screws 41 penetrate may alternatively be formed with holes.

Descriptions have so far been made of embodiments of this invention with reference to the drawings. This invention shall, however, not be limited to the above. For example, in the above-mentioned embodiments, the heat exchanger 5 for hot water supply is housed in the combustion box 4, but heat exchangers for purposes other than for hot water supply and the like, e.g., for space heating and the like, may be housed instead. Further, in the above-mentioned embodiments, the burner body 2 has formed therein an open surface 21 looking downward. It is to be noted that this invention can similarly be applied to a combustion apparatus in which a burner is disposed such that the open surface looks upward.

EXPLANATION OF MARKS

1 burner
2 burner body
21 open surface
22 body flange part
221 projection
222 bent edge part
3 combustion plate
31 ejection part
32 combustion plate flange part
32*a* notched part
4 combustion box
42 connection flange part
42*a* protruded part
9 packing
9*a* protruded part
91 combustion plate seal part
92 combustion box seal part
92*a* that circumference of combustion box seal part which coincides with the position of fixing

The invention claimed is:

1. A combustion apparatus comprising:

a burner made up of a burner body which is supplied therein with air-fuel mixture, and a sheet-metal combustion plate which covers an open surface of the burner body and has an ejection part for the air-fuel mixture;

a combustion box which has, at one end, a connection flange part 42 adapted to be coupled to a body flange part enclosing the open surface of the burner body, and which contains therein a heat exchanger; and cooling means which is disposed in that portion of the combustion box which lies between the burner and the heat exchanger, thereby cooling the combustion box;

wherein a packing is interposed between the body flange part and a combustion plate flange part 32 on a circumference of the combustion plate which protrudes outward beyond an inner circumference of the body flange part; and wherein the connection flange part is coupled to the body flange part by a fastening operation in a state in which the connection flange part is in direct contact with the combustion plate flange part so as to release heat to the connection flange part, and the packing has a combustion plate seal part which is compressed, as a result of the fastening operation, between the combustion plate flange part and the body flange part.

2. The combustion apparatus according to claim 1, wherein the body flange part has a projection which is formed so as to contact the combustion plate flange part through a hole formed in the packing.

3. The combustion apparatus according to claim 1, wherein an outer circumference of the combustion plate flange part is positioned on an inner side of an outer circumference of the body flange part, wherein the connection flange part and the packing respectively have protruded parts which protrude outward beyond the outer circumference of the combustion plate flange part, and wherein a combustion box seal part is disposed at the protruded part of the packing so as to be compressed, as a result of the fastening operation, between the protruded part of the connection flange part and the body flange part.

4. The combustion apparatus according to claim 3, wherein the outer circumference of the body flange part has a bent edge part which is bent so as to come into contact with an outer circumference portion of that surface of the protruded part of the connection flange part which faces the body flange part.

5. The combustion apparatus according to claim 3, wherein a coupling position of the connection flange part to the body flange part is formed to position on an outside of the outer circumference of the combustion plate flange part, and the combustion box seal part is formed to position on an inside of the coupling position at a circumference coinciding with the coupling position, wherein a notched part is formed in outer circumference of the combustion plate flange part so as to be positioned at the circumference coinciding with the coupling position, and wherein a circumference coinciding with the coupling position of the combustion box seal part is bent inward so as to be contained into the notched part.

6. The combustion apparatus according to claim 1, wherein the packing is only one single packing.

7. The combustion apparatus according to claim 1, wherein the packing is made of rubber.

* * * * *